US005206912A

United States Patent [19]

Noro

[11] Patent Number: 5,206,912

[45] Date of Patent: Apr. 27, 1993

[54] POWER AMPLIFIER ADAPTER

[75] Inventor: Masao Noro, Hamamatsu, Japan

[73] Assignee: Yamaha Corporation, Hamamatsu, Japan

[21] Appl. No.: 538,999

[22] Filed: Jun. 15, 1990

[30] Foreign Application Priority Data

Jun. 20, 1989 [JP] Japan ..... 1-155800

[51] Int. Cl.[5] ..... H04R 3/00

[52] U.S. Cl. ..... 381/96; 381/59

[58] Field of Search ..... 381/96, 59

[56] References Cited

U.S. PATENT DOCUMENTS

| | | | |
|---|---|---|---|
| 4,180,706 | 12/1979 | Bakgaard | 381/96 |
| 4,908,870 | 3/1990 | Nagi | 381/59 |
| 4,943,956 | 7/1990 | Noro | 381/96 |
| 4,949,384 | 8/1990 | Noro et al. | 381/96 |
| 4,969,195 | 11/1990 | Noro | 381/59 |
| 4,980,920 | 12/1990 | Noro et al. | 381/59 |
| 5,031,500 | 7/1991 | Koike et al. | 381/96 |

FOREIGN PATENT DOCUMENTS

| | | | |
|---|---|---|---|
| 0361444 | 4/1990 | European Pat. Off. | 381/96 |
| 0366109 | 5/1990 | European Pat. Off. | 381/96 |

*Primary Examiner*—Forester W. Isen

*Attorney, Agent, or Firm*—Spensley Horn Jubas & Lubitz

[57] ABSTRACT

An adapter is used in combination with a power amplifier in order to apparently change transfer characteristics of the power amplifier when a loudspeaker is driven by the power amplifier. The adapter comprises a first to forth terminal, a connecting circuit and a feedback circuit. The first terminal is connected to a signal source; the second terminal is connected to a signal input terminal of the power amplifier; the third terminal is connected to an output terminal of the power amplifier; and the fourth terminal substantially directly connected to the third terminal and connected to the loudspeaker. The connecting circuit connects the first terminal with the second terminal. The feedback circuit comprises a current detection means for detecting a current flowing through the loudspeaker through the fourth terminal and positively feeding back the current to the input side of the power amplifier through the second terminal.

5 Claims, 6 Drawing Sheets

POWER AMPLIFIER ADAPTER

BACKGROUND OF THE INVENTION

1. Field of the Invention

The present invention relates to an adapter used in combination with a power amplifier for driving a loudspeaker (hereinafter referred to simply as a "speaker") in order to change transfer characteristics of the power amplifier and to drive the speaker. An adapter of this type is suitably used for effecting a negative impedance driving on a speaker when a commercially available power amplifier is used.

2. Description of the Prior Art

As a conventional driver for driving a speaker unit assembled in a speaker system, a power amplifier whose output impedance is substantially zero is generally used.

A conventional speaker system is arranged to exhibit optimal acoustic output characteristics when it is constant-voltage driven by such a power amplifier whose output impedance is substantially zero.

FIG. 7 is a sectional view of a conventional closed type speaker system. As shown in the Figure, a hole is formed in the front surface of a closed cabinet 1, and a dynamic speaker unit 3 having a diaphragm 2 and a driver is mounted over the hole.

A lowest resonance frequency $f_{oc}$ and a Q value $Q_{oc}$ at the frequency $f_{oc}$ of the closed type speaker system are respectively given by:

$$f_{oc}=f_o(1+S_c/S_o)^{\frac{1}{2}} \quad (1)$$

$$Q_{oc}=Q_o(1+S_c/S_o)^{\frac{1}{2}} \quad (2)$$

where $f_o$ and $Q_o$ are respectively the lowest resonance frequency and Q value of the dynamic speaker unit 3, i.e., those when the speaker unit 3 is attached to an infinite plane baffle. $S_o$ is the equivalent stiffness of a vibration system, and $S_c$ is the equivalent stiffness of the cabinet 1.

In the closed type speaker system, the lowest resonance frequency $f_{oc}$ serves as a standard of a bass sound reproduction limit of a uniform reproduction range, i.e., a lowest reproduction frequency. The Q value $Q_{oc}$ relate to a reproduction characteristic curve around the resonance frequency $f_{oc}$. If the Q value $Q_{oc}$ is too large, the characteristic curve becomes too sharp around $f_{oc}$. If the Q value $Q_{oc}$ is too small, the characteristic curve becomes too moderate. In either case, the flatness of the reproduction frequency characteristics is impaired. The Q value $Q_{oc}$ is normally set to be about 0.8 to 1.

FIG. 8 is a sectional view showing an arrangement of a conventional phase-inversion type (bass-reflex type) speaker system. In the speaker system shown in the Figure, a hole is formed in the front surface of a cabinet 1, and a dynamic speaker unit 3 having a diaphragm 2 is mounted over the hole. A resonance port (bass-reflex port) 8 having a sound path 7 is arranged below the speaker unit 3. The resonance port 8 and the cabinet 1 constitute a Helmholtz resonator. In this Helmholtz resonator, an air resonance phenomenon occurs due to an air spring in the cabinet 1 as a closed cavity and an air mass in the south path 7. A resonance frequency $f_{op}$ is given by:

$$f_{op}=c(A/lV)^{\frac{1}{2}}/2\pi \quad (3)$$

where c is the velocity of sound, A is the sectional area of the sound path 7, l is the length of the sound path 7, and V is the volume of the cabinet 1. In a conventional bass-reflex type speaker system according to a standard setting, such a resonance frequency $f_{op}$ is set to be slightly lower than the lowest resonance frequency $f_{oc}'$ ($\approx f_{oc}$) of the speaker unit 3 which is assembled in the bass-reflex type cabinet 1. At a frequency higher than the resonance frequency $f_{op}$, the sound pressure from the rear surface of the diaphragm 2 inverts its phase oppositely in the sound path 7, whereby the direction radiation sound form the front surface of the diaphragm 2 and the sound from the resonance port 8 are in-phase in front of the cabinet 1, thus constituting an in-phase addition to increase the sound pressure. As a result of the in-phase addition, the lowest resonance frequency of the whole system is lowered to the resonance frequency $f_{op}$ of the resonator. According to an optimally designed bass-reflex type speaker system, the frequency characteristics of an output sound pressure can be expanded even to below the lower resonance frequency $f_{oc}'$ of the speaker unit 3. As indicated by an alternate one long and two short dashed line in FIG. 9, the uniform reproduction range can be widened as compare to those of an infinite plane baffle (indicated by a solid line) and a closed type baffle (indicated by an alternate one long and one short dashed line).

In the equations (1) and (2), the equivalent stiffness $S_c$ is inversely proportional to a volume V of the cabinet 1. Therefore, when the speaker system shown in FIG. 7 or 8 is constant-voltage driven, its frequency characteristics, in particular, low-frequency characteristics are influenced by the volume V o the cabinet 1. Thus, it is difficult to make the cabinet 1 and the speaker system compact without impairing the low-frequency characteristics.

For example, in order to compensate for bass sound reproduction capacity reduced when the cabinet is made compact, as shown in FIGS. 10(*a*) to 10(*d*), a bass sound may e boosted by a tone control, a graphic equalizer, a special-purpose equalizer, or the like. In this method, an input voltage is increased with respect to a range below $f_{oc}$ which is not easy to reproduce, thereby increasing a sound pressure. With this method, it is possible to increase a sound pressure below $f_{oc}$. However, adverse influences caused by high $Q_{oc}$ due to a compact cabinet, such as poor transient response at $f_{oc}$ due to high $Q_{oc}$, an abrupt phase shift at $f_{oc}$ due to high $Q_{oc}$, and the like, cannot be eliminated. Therefore, this method merely has an effect of increasing a sound pressure of a bass sound, and cannot provide sound quality equivalent to that of a speaker system which uses a cabinet having an optimal volume V and has proper $f_{oc}$ and $Q_{oc}$.

Furthermore, in the bass-reflex speaker system shown in FIG. 8, in order to flatten frequency characteristics upon constant-voltage driving, for example, the Q value $Q_{oc}'$ of the speaker unit 3 assembled in the bass-reflex cabinet must be set to be $Q_{oc}'=1/\sqrt{3}$, and the resonance frequency $f_{oc}'$ must be set to be $f_{op}=f_{oc}'/\sqrt{2}$, so that the characteristics values ($f_o$ and $Q_o$) of the speaker unit 3, the volume V of the cabinet 1, and dimensions (A and l) of a resonance port 8, and the like must be matched with high precision, resulting in many design limitations. In this case, $Q_{oc}'$ and $f_{oc}'$ can be approximated to $Q_{oc}$ and $f_{oc}$ in equation (1) and (2).

FIG. 11 shows a negative impedance generator described in U.S. patent application Ser. No. 07/286,869, now U.S. Pat. No. 4,987,564, previously assigned to the same assignee as in the present application.

According to a driving system using such a negative impedance generator (to be referred to as negative resistance driving system hereinafter) as a driver for a speaker system, for causing an output impedance to include a negative resistance $-R_0$ to reduce or eliminate the voice coil resistance $R_V$ of a speaker, the $Q_{oc}$ and $Q_{oc}'$ can be decreased and $Q_{op}$ can be increased as compared to those when the speaker is constant-voltage driven by the power amplifier having an output impedance of zero. Thus, the speaker system can be rendered compact, and acoustic output characteristics can be improved.

Such a speaker system using such a negative resistance driving system is described in U.S. patent application Ser. No. 07/323,680, now U.S. Pat. No. 4,997,564 previously assigned to the same assignee as in the present application.

In the above U.S. application, a closed type speaker system or bass-reflex type speaker system to be used in the normal way, that is, subjected to constant-voltage driving, is provided on or in the cabinet thereof with an open duct port having a predetermined size and driven by an amplifier of a negative resistance driving type, thereby expanding low range reproduction characteristics as compared with the original speaker system which was used in said normal way.

However, when the negative resistance driving system of the U.S. Pat. No. 4,987,564 is to be adopted, a special-purpose driving apparatus is necessary, and a conventional power amplifier cannot be used, resulting in a large economical load on a user.

SUMMARY OF THE INVENTION

The present invention has been made in consideration of the conventional problems, and has as its object to provide an adapter which is combined with a commercially available power amplifier, so that transfer characteristics of the power amplifier are changed to desired characteristics, thereby driving a speaker.

In order to achieve the above object, an adapter of the present invention comprises a first terminal for receiving a speaker driving original signal, a connecting circuit connected between the first terminal and a second terminal for supplying an output signal of the connecting circuit to a power amplifier, a third terminal for receiving an output from the power amplifier again, a fourth terminal for supplying a signal to a speaker, and a feedback circuit for detecting a current flowing through the speaker through the fourth terminal and positively feeding back the current to an input terminal of the power amplifier. The third and fourth terminals are substantially directly connected to each other.

With the adapter of the present invention, the first terminal is connected to a signal source such as a preamplifier, a line amplifier, or the like, the second terminal is connected to an input terminal of the power amplifier, the third terminal is connected to an output terminal of the power amplifier, and the fourth terminal is connected to the speaker, thereby constituting a negative impedance generator as shown in the U.S. Pat. No. 4,987,564 as a whole. Therefore, in this case, the speaker cabinet can be rendered compact without impairing sound quality and output sound-frequency characteristics of a speaker, as described in the specification of the U.S. Pat. No. 4,987,564. In addition, an existing speaker system can be driven to improve sound quality and frequency characteristics, especially, low-frequency characteristics, of the speaker system.

When a speaker system with a resonance port similar to a bass-reflex speaker system shown in FIG. 8 in shape is negative-resistance driven, an equivalent stiffness $S_c$ of a cabinet and $Q_{oc}'$ with a unit resonance system ($S_o$ and $m_o$) can be minimized or decreased to 0. Therefore, a diaphragm can be driven in a high damping state. A peak at a frequency $f_{oc}'$ shown in FIGS. 10(*a*) to 10(*d*) when a cabinet is rendered compact can be suppressed to improve sound quality. $Q_{op}$ can be set to be a relatively large value regardless of $Q_{oc}'$ described above. As a result, a speaker system can be rendered compact, and a uniform reproduction range, especially, low-frequency characteristics can be improved. Since the diaphragm is driven in a high damping state, sound pressure characteristics of a direct radiation acoustic wave by the diaphragm have a low rate of decrease in sound pressure near the lowest resonance frequency $f_o$ or less as compared to the prior art wherein a bass sound reproduction range is extended by utilizing a resonance of a unit vibration system. For example, when $Q_{oc}'=0$ (perfect damping, i.e., non-resonance state), a decrease in sound pressure below $f_o$ is about 6 dB/oct. For this reason, even if a drift of low-frequency characteristics occurs, such a drift can be corrected by increasing/decreasing a signal level by a tone control or a graphic equalizer.

Therefore, the adapter of the present invention is preferable provided with a control means such as a level control or a sound quality adjuster.

It is relatively difficult to appropriately perform such tone control. It is more difficult to simultaneously adjust an output impedance and frequency characteristics by tone control or the like in correspondence with the types of speaker or music. Thus, it is preferable that a portion storing data such as output impedances and frequency characteristics to be set according to the types of speaker or music is detachable arranged with respect to a main body portion as a control data storage body. A control data storage body corresponding to a type of speaker or music is appropriately selected and is set in the main body portion, so that an output impedance or equalizer characteristics corresponding to a desired speaker or music can be set. The control data storage body and a control circuit are disclosed in U.S. patent application Ser. No. 07/353,444, now U.S. Pat. No. 5,014,320 previously assigned to the same assignee as in the present application.

In a driving apparatus as a combination of the adapter of the present invention and a power amplifier, the gain of the power amplifier also serves as a factor for determining not only a gain of the driving apparatus but also an output impedance unlike in a normal power amplifier. Therefore, the absolute value of the gain of the power amplifier is required to have high precision. The frequency characteristics of the power amplifier also serve as a factor for determining transfer characteristics of a positive feedback loop. Therefore, the frequency characteristics according to a purpose must be selected.

However, commercially available power amplifiers have a variety of gains and frequency characteristics, and variation thereof normally occur among the same type of amplifiers.

Therefore, the adapter of the present invention preferably comprises a circuit for correcting transfer characteristics including such a gain and frequency characteristics if it is applicable to many types of power amplifiers. If the adapter is exclusively used for a specific type of power amplifier, it preferably has a circuit for correcting transfer characteristics.

DETAILED DESCRIPTION OF THE PREFERRED EMBODIMENTS

Preferred embodiments of the present invention will be described below with reference to the accompanying drawings.

Figure 1:
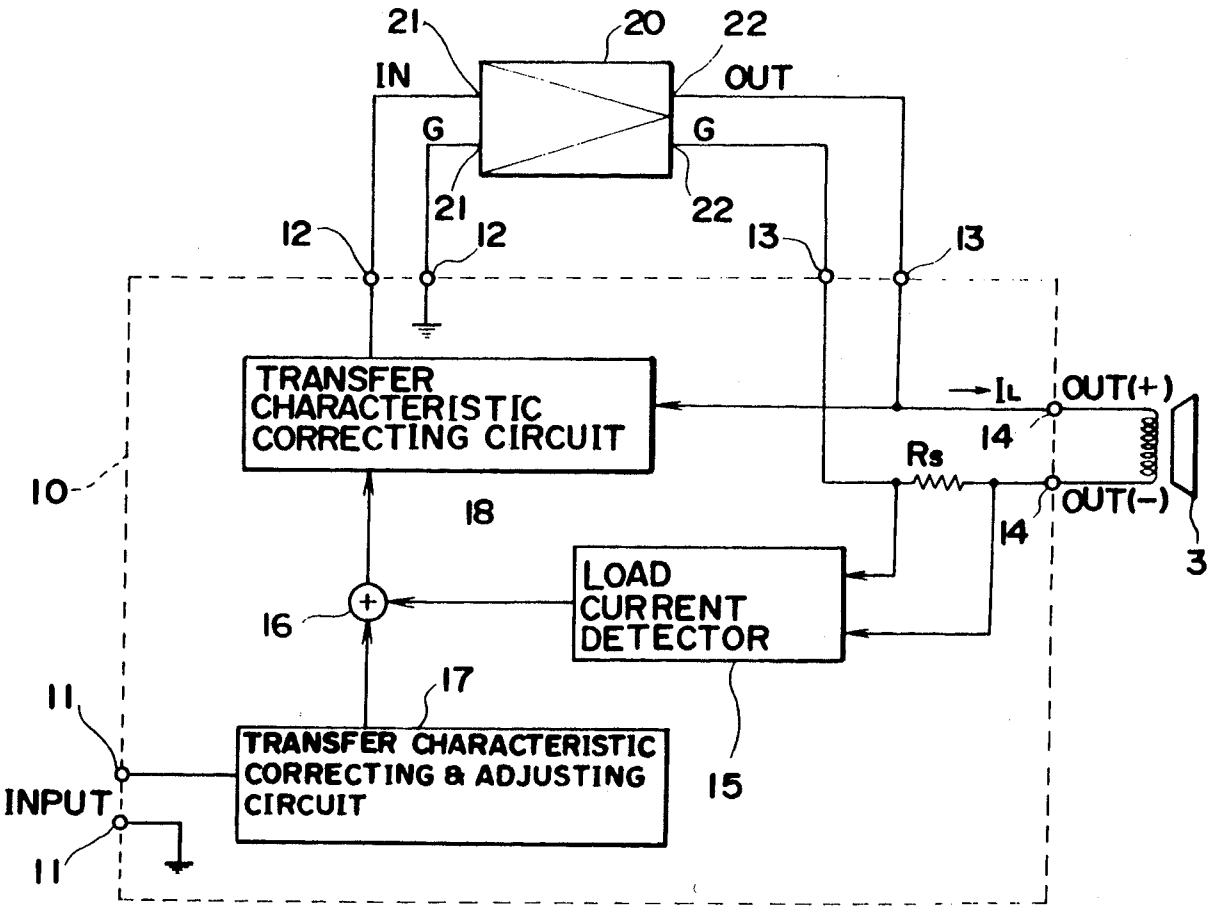
FIG. 1 is a circuit diagram showing a basic arrangement of an adapter according to an embodiment of the present invention.

FIG. 1 shows a basic arrangement of an adapter according to an embodiment of the present invention. An adapter 10 shown in FIG. 1 comprises a first terminal 11 for receiving acoustic electrical signals such as a music or voice, a second terminal 12 connected to an input terminal 21 of a power amplifier 20, a third terminal 13 connected to an output terminal 22 of the power amplifier 20, a fourth terminal 14 connected to the third terminal 13 through a small, current detection resistor $R_s$ and connected to a speaker unit 3, a load current detecting circuit 15 for detecting a current $I_L$ flowing through the speaker unit 3 through the fourth terminal 14 on the basis of a voltage across the resistor $R_2$, an adder 16 for positively feeding back the current $I_L$ to the input side of the power amplifier 20 through the second terminal, and the like.

Figure 11:
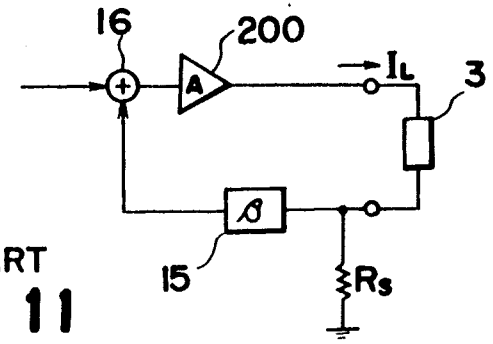
PRIOR ART FIG. 11
FIG. 11 is a circuit diagram showing a basic arrangement of a negative impedance generator according to the U.S. Pat. No. 4,987,564.

The arrangement of a driving apparatus constituted by a basic portion consisting of the terminals 11 to 14, the resistor $R_s$, and the load current detecting circuit 15 of the adapter 10 shown in FIG. 1, and the power amplifier 20 is the same as that of the U.S. Pat. No. 4,987,564 shown in FIG. 11. In the circuit shown in FIG. 11, the output from a power amplifier 200 of a grain A is supplied to a speaker unit 3 serving as a load. The current $I_L$ flowing through the speaker unit 3 is detected by the resistor $R_s$, and is fed back to the amplifier 200 through a feedback amplifier 15 having a transfer gain $\beta$. In this manner, an output impedance $Z_o$ of this circuit is given by:

$$Z_o = R_2(1 - A\beta) \tag{4}$$

From this equation, when $A\beta > 1$, the output impedance $Z_o$ becomes a open stable type negative resistance. When $A\beta = 1$, the output impedance can become zero. When $A\beta < 1$, the output impedance can have a positive value. Furthermore, when amplifier 200 or 15 is set to have a gain or phase varied depending on the frequency, a driving apparatus having different output impedances $Z_o$ depending on the frequency can be realized. The output impedance $Z_o$ can be changed by changing an impedance $Z_s$ of a current sensor for detecting the current $I_L$. In this manner, a proposal for changing the output impedance $Z_o$ of the driving apparatus according to the frequency is described in U.S. patent application Ser. No. 07/340,553, now U.S. Pat. No. 4,943,956, previously assigned to the same assignee as in the present application.

In this basic circuit, the gain A of the power amplifier 200 also serves as a factor for determining not only a gain of the driving apparatus but also an output impedance unlike in a normal power amplifier. Therefore, the absolute value of the gain of the power amplifier is required to have high precision. The frequency characteristics of the power amplifier 200 also serve as a factor for determining transfer characteristics of a positive feedback loop. Therefore, the frequency characteristics must be selected in accordance with each application. When a special-purpose amplifier is designed as a power amplifier unit of the driving apparatus shown in FIG. 11, its transfer characteristics and precision can be freely set. However, when a commercially available power amplifier is used as the power amplifier unit, its transfer characteristics and precision of the gain cannot be matched with those required for the power amplifier unit. A normal power amplifier is not designed for use in such a state.

In this manner, when transfer characteristics cannot be matched, a means for correcting the characteristics is necessary.

Figure 2:
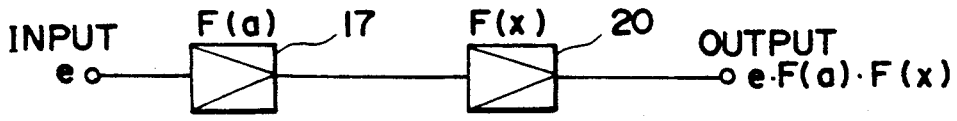
FIG. 2 is a diagram for explaining a method of correcting transfer characteristics of a power amplifier.

When a power amplifier to be used is specified, transfer characteristics and gain of the amplifier can be specified. Therefore, certain transfer characteristics can be prepared in advance to correct original characteristics. FIG. 2 shows a case wherein transfer characteristics F(x) of a power amplifier are corrected by transfer characteristics F(a) prepared in advance. The transfer characteristics f(a) can be held in a transfer characteristic correcting & adjusting circuit 17 in the adapter shown in FIG. 1.

However, in a normal power amplifier, the gain A does not have sufficiently high precision since a difference in gain A appears only as a small sound volume difference in a normal use state. The transfer characteristics are set to be flat within an audible range but are not always specified outside the audible range. For this reason, in the normal power amplifier, the transfer characteristics such as a gain or phase vary even among the same type of amplifiers, and amplifiers of different types have a variety of characteristics.

When a power amplifier suffering from a variation is used, an output impedance and its frequency characteristics vary. As a result, not only a variation in gain but also a variation in frequency characteristics and transient characteristics occur with respect to a speaker load unlike in a normal use of a power amplifier.

Figure 3:
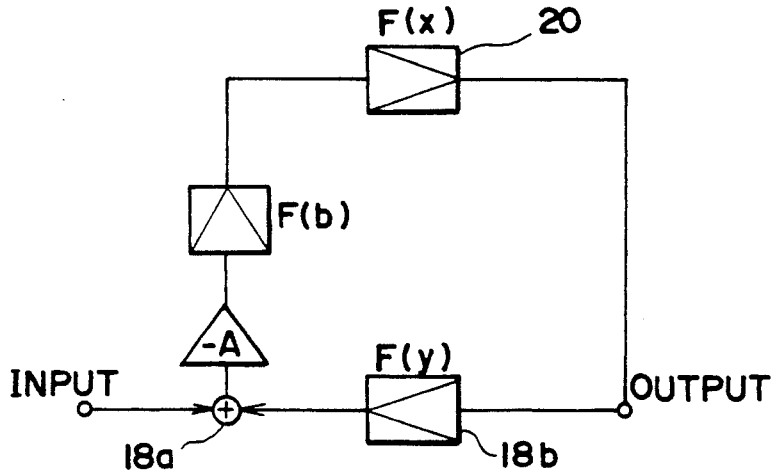
FIG. 3 is a diagram for explaining another method of correcting transfer characteristics of the power amplifier.

FIG. 3 shows a circuit for precisely setting transfer characteristics even if the transfer characteristics considerably vary. An operational amplifier having a gain −A is prepared, thus forming a new loop operated to have F(y) as feedback transfer characteristics. A power amplifier F(x) is inserted in this loop, so that a difference in characteristics can be corrected by the gain −A, and a variation can be compressed.

In FIG. 3, the following formula is established:

$$G = \frac{e_o}{e_i} = -\frac{A \cdot F(b) \cdot F(x)}{1 + A \cdot F(b) \cdot F(x) \cdot F(y)}$$

where $e_i$ and $e_o$ respectively represent input and output signal voltages.

If $A \cdot F(b) \cdot F(x) \cdot F(y) >> 1$, then
$1 + A \cdot F(b) \cdot F(x) \cdot F(y) \approx A \cdot F(b) \cdot F(x) \cdot F(y)$ Therefore, $$G \approx -\frac{A \cdot F(b) \cdot F(x)}{A \cdot F(b) \cdot F(x) \cdot F(y)} = \frac{1}{F(y)}$$

As a result, gain G can be set only by F(y).

The adapter shown in FIG. 1 comprises a transfer characteristic correcting circuit 18 for correcting the characteristics, as described above.

Figure 4:
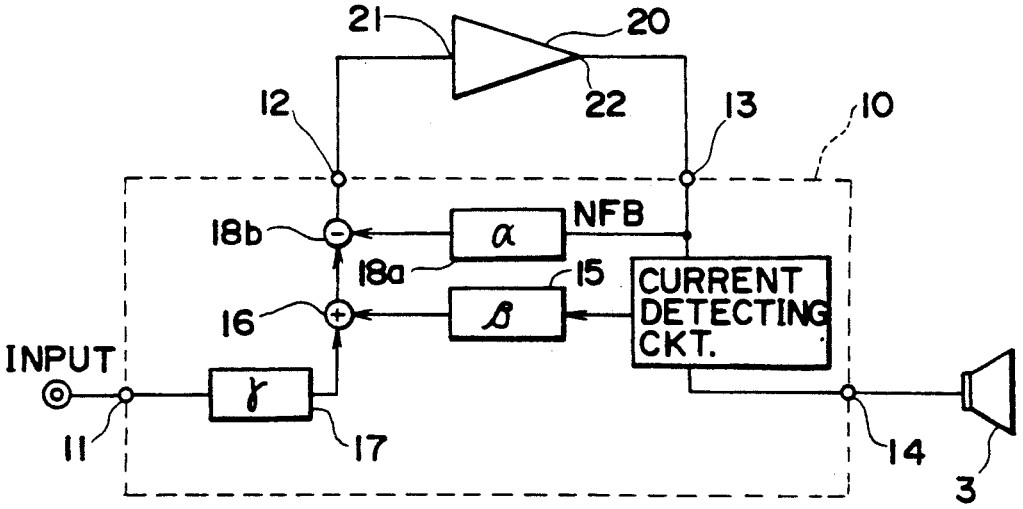
FIG. 4 is a circuit diagram in which a transfer characteristic correcting circuit portion of the adapter shown in FIG. 1 is practically rewritten.

FIG. 4 shows substantially the same arrangement as that of the adapter shown in FIG. 1 but in a different representation. More specifically, in FIG. 4, the transfer characteristic correcting circuit 18 shown in FIG. 1 is divided into a feedback amplifier 18*a* of a gain $\alpha$ and a subtracter 18*b* so as to indicate that the circuit 18 is a negative feedback circuit for correcting the characteristics of the power amplifier 20. In FIG. 4, reference symbol $\beta$ denotes a gain of a feedback amplifier 15 as a load current detecting circuit; and $\gamma$, a gain of a frequency characteristic correcting circuit (transfer characteristic correcting & adjusting circuit ) 17. These gains $\alpha$, $\beta$, and $\gamma$ are set up with frequency characteristics according to specific applications, respectively.

Figure 5:
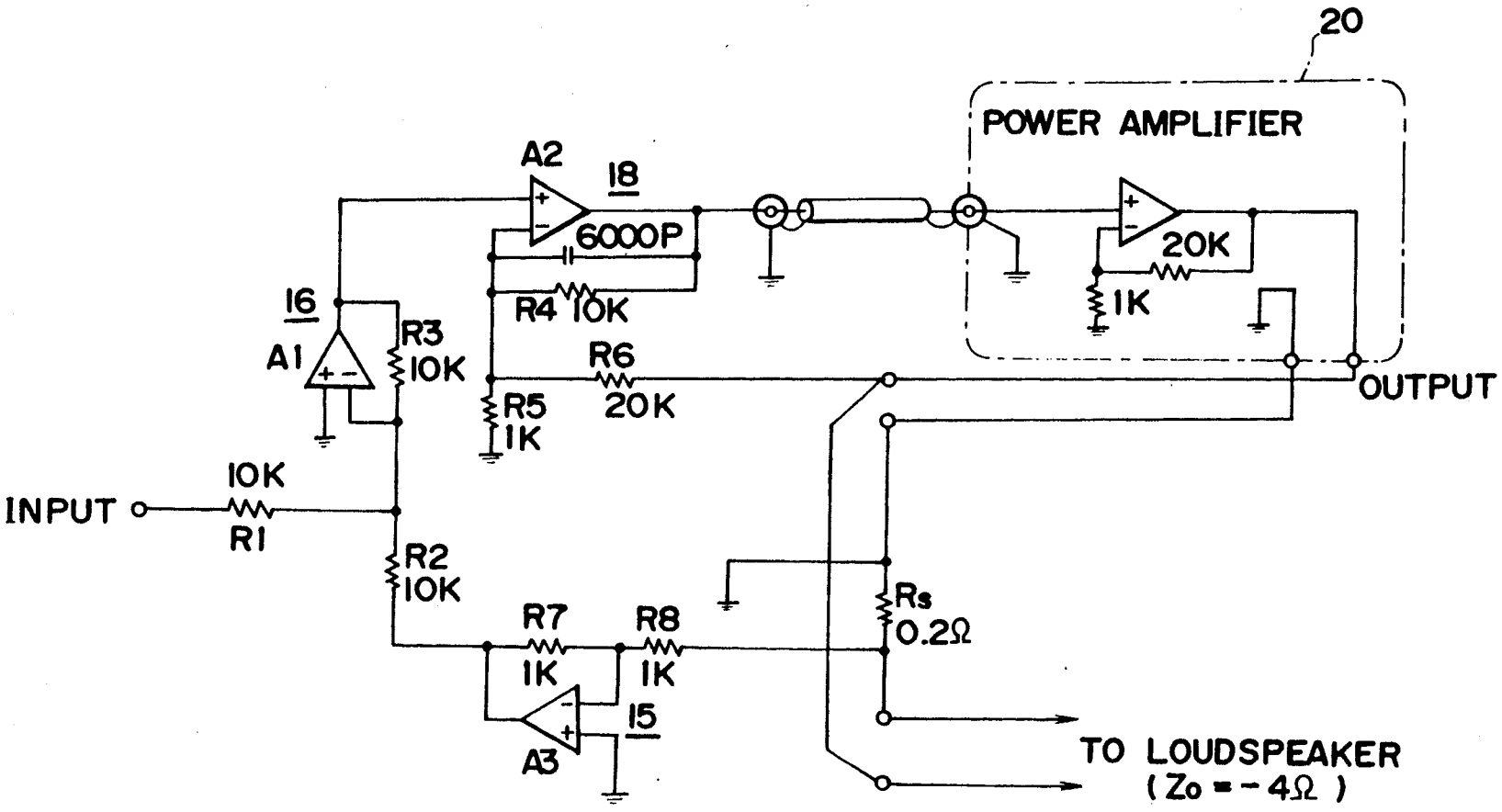
FIG. 5 is a circuit diagram showing the first embodiment of an adapter of the present invention.

FIG. 5 shows a detailed circuit arrangement of a portion corresponding to the adapter 10 and the power amplifier 20 shown in FIG. 1. In FIG. 5, an amplifier $A_1$ and resistors $R_1$ to $R_3$ constitute the adder 16 shown in FIG. 1. An amplifier $A_2$, resistors $R_4$ to $R_6$, and the like constitute an error absorption amplifier corresponding to the transfer characteristic correcting circuit 18 shown in FIG. 1. An amplifier $A_3$ and resistors $R_7$ and $R_8$ constitute a feedback amplifier corresponding to the load current detecting circuit 15 shown in FIG. 1. In the circuit shown in FIG. 5, the gain A defined by the power amplifier 20 and the error absorption amplifier 18 is given by:

$$A = (R_6 + R_5)/R_5 = 21 \text{ (times)}$$

A transfer gain $\beta$ is given by:

$$\beta = R_7/R_8 = 1 \text{ (time)}$$

Therefore, the output impedance $Z_o$ is given by:

$$\begin{aligned} Z_o &= R_s(1 - AB) \\ &= 0.2(1 - 21 \times 1) \\ &= -4\ \Omega \end{aligned}$$

Figure 6:
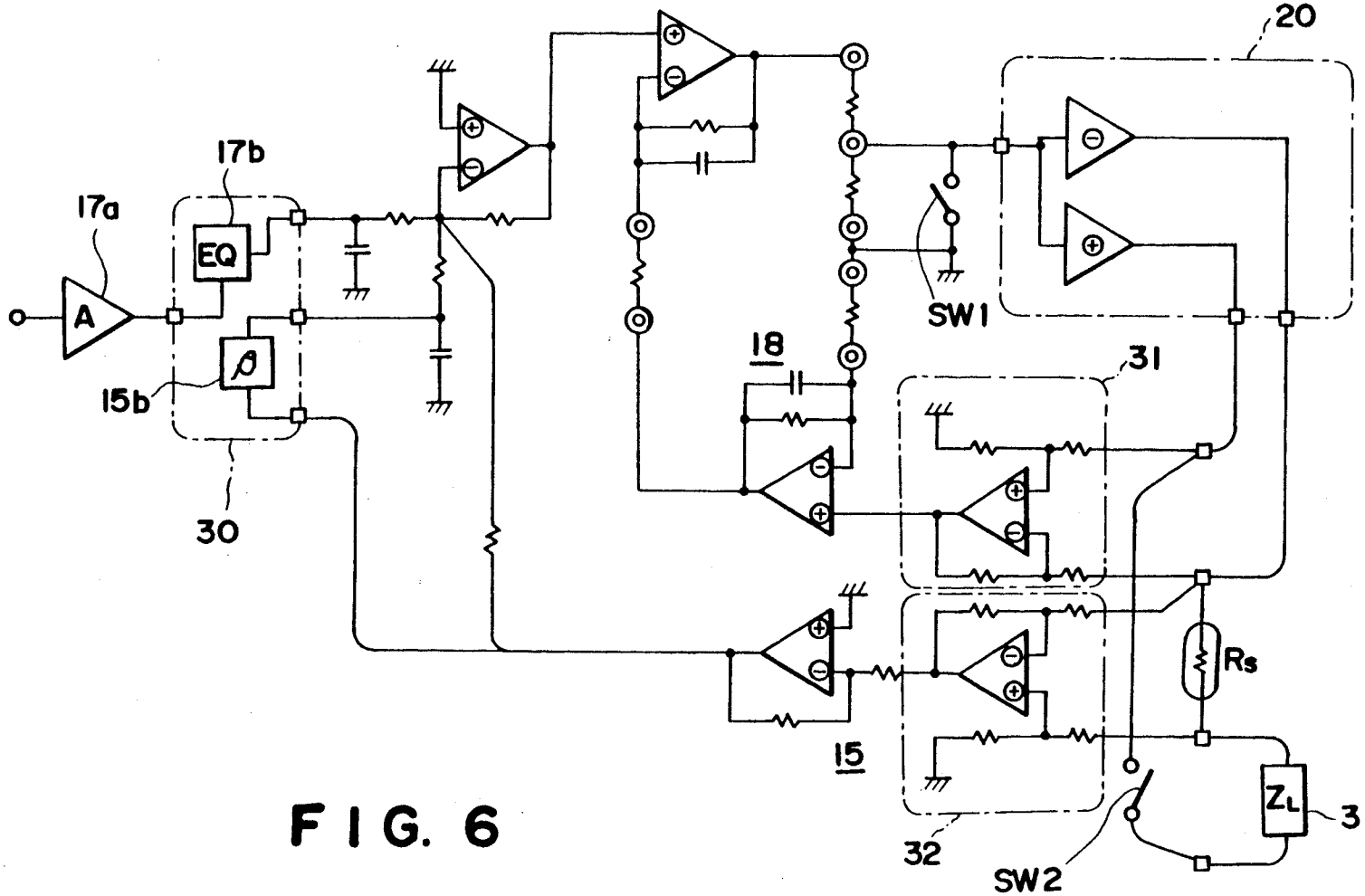
FIG. 6 is a circuit diagram showing the second embodiment of an adapter of the present invention.
Figure 7:
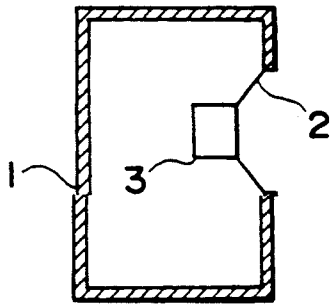
PRIOR ART FIG. 7
FIG. 7 is a sectional view showing an arrangement of a conventional closed type speaker system.
Figure 8:
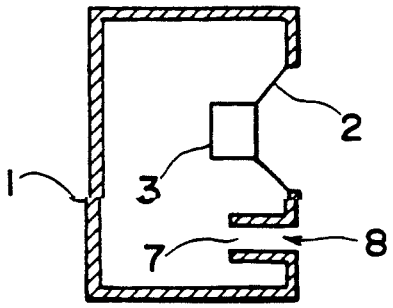
PRIOR ART FIG. 8
FIG. 8 is a sectional view showing a conventional bass-reflex speaker system.
Figure 9:
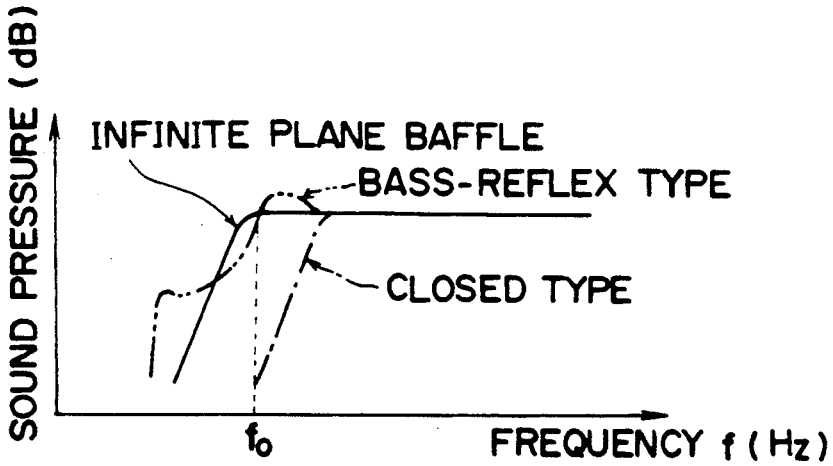
PRIOR ART FIG. 9
FIG. 9 is a graph for explaining sound pressure characteristics of the speaker systems shown in FIGS. 7 and 8.
Figures 10A, 10B, 10C, 10D:
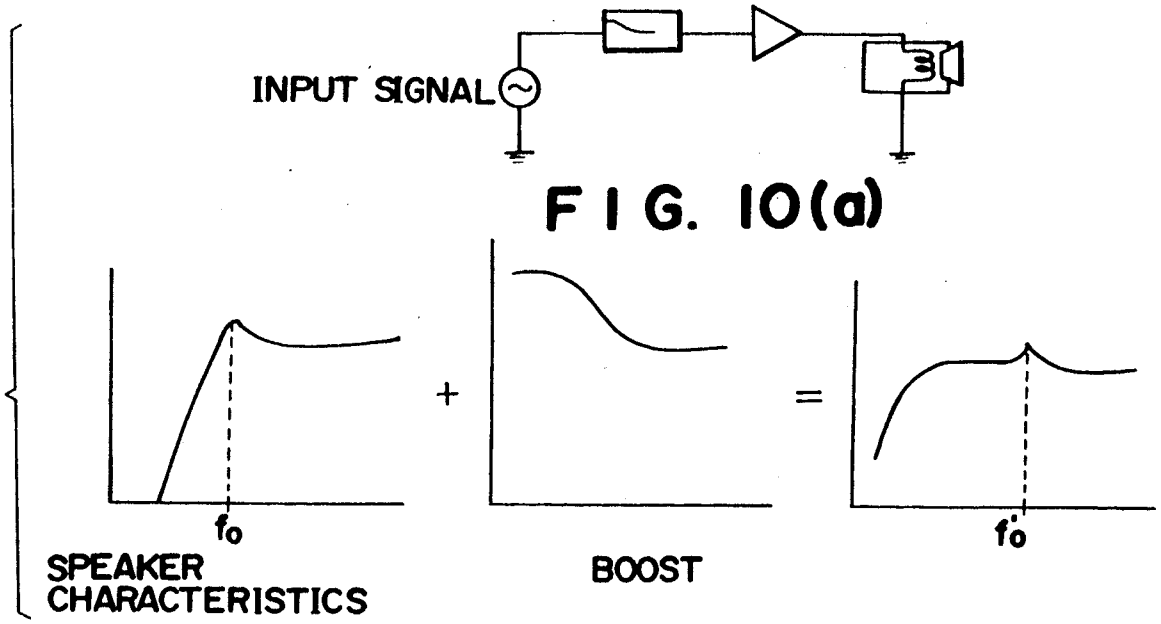
FIG. 10(*a*) to 10(*d*) are a diagram and graphs for explaining a circuit and frequency characteristics when a speaker unit attached to a compact cabinet is constant-voltage driven by a bass sound boost signal.

FIG. 6 shows a detailed arrangement of an adapter 10 of a BTL (Balanced Transformer-Less) amplifier 20. In FIG. 6, switches SW1 and SW2 for muting are provided as a speaker protecting circuit, and differential amplifiers 31 and 32 are respectively used for detecting the output voltage and current of the BTL amplifier in order that they are used for feedback signals. In the adapter shown in FIG. 6, a portion corresponding to the transfer characteristic correcting & adjusting circuit 17 shown in FIG. 1 is divided into a buffer amplifier 17*a* and an equalizer circuit 17*b*, and the load current detecting circuit 15 is divided into a portion 15*b* for determining the gain of the detecting circuit 15 and other potions, so that the equalizer circuit 17*b* and the gain determining portion 15*b* are arranged as a cartridge 30 separate from the adapter main body 10. Thus, the adapter 10 can appropriately easily set transfer characteristics, frequency characteristics, and the like in correspondence with the types of speaker and music by exchanging the cartridge 30 according to a desired type of speaker or music.

As described above, according to the present invention, a driving apparatus such as a negative impedance driving apparatus having transfer characteristics different from those of a normal power amplifier can be constituted by using a normal amplifier, e.g., a commercially available power amplifier. Therefore, a user who possesses a conventional power amplifier need only purchase an adapter, thus improving his or her system at low cost.

When a portion of an adapter is separated as a control data storage body, its versatility can be improved, and appropriate characteristics can be easily set in correspondence with a desired speaker and music.

What is claimed is:

1. An adapter used in combination with a power amplifier in order to apparently change transfer characteristics of said power amplifier when a loudspeaker is driven by said power amplifier, comprising:

a first terminal connected to a signal source;

a second terminal connected to a signal input terminal of said power amplifier;

a third terminal connected to an output terminal of said power amplifier;

a fourth terminal substantially directly connected to said third terminal and connected to said loudspeaker;

a connecting means for connecting the first terminal with the second terminal;

a feedback circuit, comprising current detection means for detecting a current flowing through said loudspeaker through said fourth terminal, for positively feeding back the current to the input side of said power amplifier through said second terminal; and a transfer characteristic correcting circuit for negatively feeding back an output of said power amplifier inputted through said third terminal to the input side of said power amplifier through said second terminal.

2. An adapter according to claim 1, wherein said transfer characteristic correcting circuit is set to have a gain so that a desired transfer characteristic is obtained depending on the characteristics of said power amplifier.

3. An adapter used in combination with a power amplifier in order to apparently change transfer characteristics of said power amplifier when a loudspeaker is driven by said power amplifier, comprising:

a first terminal connected to a signal source;

a second terminal connected to a signal input terminal of said power amplifier;

a third terminal connected to an output terminal of said power amplifier;

a fourth terminal substantially directly connected to said third terminal and connected to said loudspeaker;

a connecting means for connecting the first terminal with the second terminal; and a feedback circuit, comprising current detection means for detecting a current flowing through said loudspeaker through said fourth terminal, for positively feeding back the current to the input side of said power amplifier through said second terminal, wherein said connecting means includes a frequency characteristic correcting circuit which is set to have a variable gain dependent on the frequency of input signals.

4. An adapter used in combination with a power amplifier in order to apparently change transfer characteristics of said power amplifier when a loudspeaker is driven by said power amplifier, comprising:

a first terminal connected to a signal source;

a second terminal connected to a signal input terminal of said power amplifier;

a third terminal connected to an output terminal of said power amplifier;

a fourth terminal substantially directly connected to said third terminal and connected to said loudspeaker;

a connecting means for connecting the first terminal with the second terminal; and a feedback circuit, comprising current detection means for detecting a current flowing through said loudspeaker through said fourth terminal, for positively feeding back the current to the input side of said power amplifier through said second terminal, wherein said adapter is divided into an adapter main body, and a control data storage body which stores control data for determining transfer characteristics and is arranged to be detachable from said adapter main body.

5. An adapter used in combination with a power amplifier in order to apparently change transfer characteristics of said power amplifier when a loudspeaker is driven by said power amplifier, said power amplifier having substantially zero output impedance and providing for constant voltage driving of the loudspeaker, the adapter comprising:

a first terminal connected to a signal source;

a second terminal connected to a signal input terminal of said power amplifier;

a third terminal connected to an output terminal of said power amplifier;

a fourth terminal substantially directly connected to said third terminal and connected to said loudspeaker;

connecting means for connecting the first terminal with the second terminal; and a feedback circuit including current detection mans for detecting a current flowing through said loudspeaker through said fourth terminal and for positively feeding back the current to the input side of said power amplifier through said second terminal;

said connecting means including a frequency characteristic correcting circuit which is set to have a variable gain dependent on the frequency of input signals.

* * * * *